US006448423B1

(12) United States Patent
Hernandez et al.

(10) Patent No.: US 6,448,423 B1
(45) Date of Patent: Sep. 10, 2002

(54) REFINING OF GLYCERIDE OILS BY TREATMENT WITH SILICATE SOLUTIONS AND FILTRATION

(75) Inventors: Ernesto Hernandez, Bryan; Steve J. Rathbone, College Station, both of TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 09/568,071

(22) Filed: May 10, 2000

Related U.S. Application Data

(60) Provisional application No. 60/133,354, filed on May 10, 1999.

(51) Int. Cl.[7] ..... C11B 3/10
(52) U.S. Cl. ..... 554/197; 554/206
(58) Field of Search ..... 554/191, 206

(56) References Cited

U.S. PATENT DOCUMENTS

| | | | | |
|---|---|---|---|---|
| 1,007,642 A | * | 10/1911 | Chisholm | 554/191 |
| 2,512,245 A | | 6/1950 | Fash | 260/425 |
| 4,629,588 A | | 12/1986 | Welsh et al. | 260/428 |
| 4,764,384 A | * | 8/1988 | Gyann | 426/417 |
| 4,880,574 A | | 11/1989 | Welsh | 260/428 |
| 5,069,829 A | | 12/1991 | Van Dalen et al. | 260/428 |
| 5,229,013 A | | 7/1993 | Regutti | 210/778 |
| 5,248,799 A | | 9/1993 | Schmutzler | 554/192 |
| 5,252,762 A | | 10/1993 | Denton | 554/196 |
| 5,264,597 A | | 11/1993 | Van Dalen et al. | 554/191 |
| 5,298,639 A | | 3/1994 | Toeneboehn et al. | 554/192 |
| 5,336,794 A | * | 8/1994 | Pryor et al. | 554/206 |
| 5,744,145 A | | 4/1998 | Bertoli et al. | 424/401 |

FOREIGN PATENT DOCUMENTS

| | | | |
|---|---|---|---|
| GB | 1230409 | 4/1968 | C11B/3/00 |
| WO | 0340717 | 2/1989 | C11B/3/10 |
| WO | 9425551 | 11/1994 | C11B/3/10 |

OTHER PUBLICATIONS

R.A. Yates and J.D. Caldwell; Regeneration of Oils Used for Deep Frying: A Comparison of Active Filter Aids; JAOCS, vol. 70, No. 5 (May 1993).

S.B. Mukhopadhyay, P.K. Gupta and A.K. Basu; Dry Refining of Sesame Oil with Alkali–Enriched Sodium Metasilicate; JAOCS, vol. 69, No. 3 (Mar. 1992).

* cited by examiner

*Primary Examiner*—Deborah D. Carr
(74) *Attorney, Agent, or Firm*—Bracewell & Patterson LLP

(57) ABSTRACT

This invention relates to the refining of glyceride oils in the food industry. More particularly, this invention is directed to the removal of free fatty acids and soapstock from oils during refining. The method and apparatus of the invention contact the crude glyceride oil with an agglomerating agent, preferably a soluble silicate solution, such that the contaminants agglomerate in a discrete phase. This discrete phase is separated from the liquid oil phase through physical separation means, preferably filtration.

22 Claims, 5 Drawing Sheets

REFINING OF GLYCERIDE OILS BY TREATMENT WITH SILICATE SOLUTIONS AND FILTRATION

This application claims priority from U.S. Provisional Patent application Serial No. 60/133,354, filed May 10, 1999 by Ernesto Hernandez and Steve J. Rathbone, entitled Refining of Triglyceride Oils by Treatment with Silicate Solutions and Filtration.

BACKGROUND OF THE INVENTION

1. Field of the Invention

This invention relates to the refining of glyceride oils in the food industry. More particularly, this invention is directed to the removal of free fatty acids and soapstock from oils during refining.

2. Description of the Prior Art

Unrefined glyceride oils contain undesirable minor components or impurities such as pigments, free fatty acids, phospholipids and oxidation products which, unless removed, render the oil commercially unsuitable in that they produce undesirable color or an "off" flavor. Further, higher melting components such as wax are undesirable and must be removed from glyceride oils if they are to be used in food products such as salad oil as such components "crystalize" and separate from the rest of the oil when refrigerated. Such unrefined oils are generally refined by one or several of the following steps: degumming, neutralizing or alkali refining to reduce the fatty acid content thereof, bleaching, dewaxing and deodorization. To bleach, the neutralized oil is typically heated in the presence of bleaching clay, such as Fuller's earth, a naturally porous aluminum silicate. The oil is then subjected to a separation process after which it may be further polished and processed. The spent Fuller's earth contains from 15–50 percent by weight glyceride oil. This can account for a loss of 2% of the oil stream and can result in a waste product which is environmentally unfriendly.

In refining of glyceride oils, such as vegetable oils, free fatty acids are neutralized through an alkali process. Such neutralization is typically performed through the addition of a 10–15% sodium hydroxide solution to the crude oil, which also acts to hydrate gums or lecithin also present. In neutralizing the free fatty acids, "soapstock" is formed from the free fatty acids. This soapstock, or "heavy phase," must be removed from the oil as it will otherwise inactivate bleaching clay and further deteriorates the oil during the deodorizing step. Removal is typically performed by continuous centrifugation. Phospholipids, after treatment with alkali, precipitate out with the soapstock. Sometimes the refining stage is carried out in two steps, as in the case of soybean oil processing where first the gums are separated by hydration and centrifuged and then the oil is neutralized with caustic solution and removed by centrifuging. Other alkali solutions, such as sodium bicarbonate, calcium hydroxide, potassium hydroxide, magnesium hydroxide, ammonia, and some organic bases are known in the art of alkali refining of a crude glyceride oil. There is a need for an alternative to caustic refining, such as a physical refining where oil impurities are removed by physical means. There is also a need for a separation technique of increased economic efficiency as compared to centrifugation.

Centrifugation operations are usually more expensive than other physical separation techniques, produce more oil loss and sometimes require the use of a water wash. A water wash becomes necessary when saponified free fatty acids, or soap, become entrained in the oil. Under these conditions, the centrifuged oil is washed with hot water in an amount up to 15% of the oil weight. The use of extra water requires an additional centrifuging step for removal and creates a waste product that is considered a pollutant and thus is not readily disposable.

It is an object of the invention to provide a process of refining glyceride oil wherein the undesirable components are removed from the crude glyceride oil.

It is a further object to provide a process whereby a non-caustic treatment is used to neutralize impurities in crude glyceride oil.

It is a further object of the invention to create at least a two-phase system to facilitate separation of impurities from the glyceride oil.

It is yet another object to separate a discrete phase from a liquid phase based upon physical characteristics of each phase.

It is yet a further object of the invention to provide an economic alternative to centrifugation as a method of separating impurities from the glyceride oil.

It is yet a further object of the invention to remove impurities from glyceride oil through filtration.

BRIEF SUMMARY OF THE INVENTION

The present invention includes a method and apparatus for removal of soapstock from oils during refining through the use of a liquid refining agent that causes the soapstock to agglomerate allowing for physical separation. The method of the current invention of refining glyceride oil to remove contaminants includes contacting the glyceride oil with an agglomeration agent, causing the contaminants to agglomerate, and physically separating the agglomerated contaminants from the glyceride oil. Glyceride oils or glycerides are found in vegetable oils, such as soybean oil, corn oil, linseed oil, olive oil and peanut oil, and in animal fats, such as lard, tallow, and butter. There are monoglycerides, in which only one OH group of glycerol has been esterified, and diglycerides and triglycerides. Triglycerides are transformed by the human body to release energy or to be deposited as fat. Triglycerides are thus a desirable component of food oils.

Of the many types of glyceride oils derived from vegetables, rice bran oil is unique in that it contains oryzanol. Oryzanol, a valuable nutrient, is destroyed by caustic treatment. The current invention preserves the oryzanol content of the refined oil product. Soybean oil is also notable due to the large volume produced worldwide.

The contaminants that are most often encountered in crude oils and that are agglomerated by the method of the current invention include free fatty acids, waxes, metal ions, phospholipids, pigments or oxidation products.

The agglomeration agent in a preferred embodiment is a soluble silicate solution, the concentration of soluble silicate solution being effective to form a discrete phase and liquid phase, the liquid phase containing the oil. When contacting the agglomeration agent with the oil, the oil preferably has a temperature maintained above 150° F. (~66° C.). More specifically, maintaining the temperature between 170° F. (~77° C.) and 200° F. (~93° C. ) is preferred.

The concentration of soluble silicate is from at least fifteen (15) percent by weight in the soluble silicate solution up to the solubility limit. A preferred percentage is at least 30%. A preferred form of soluble silicate in the solution is sodium silicate with a weight ratio of silicon dioxide to sodium oxide is less than about 3.3, and preferably between 0.91 to 3.3.

Physical separation is performed by filtration. Optionally, a filter aid may be employed to facilitate filtration. Examples of such filter aids include diatomaceous earth and Fuller's earth, among others.

An embodiment of the method of the invention includes the addition of a bleaching agent that functions to bleach and facilitate filtration. The bleaching agent is introduced in one of several ways including addition during refining or contact through pre-coating on a filter. Certain substances act as both a filter aid as well as interacting in the bleaching/deodorizing process.

The present invention includes an apparatus for refining crude glyceride oil to remove contaminants including a refining vessel for receiving the crude glyceride oil and an agglomeration agent, the agglomeration agent causing the contaminants to agglomerate within the refining vessel. Separation means is also provided to physically separate the agglomerated contaminants from the glyceride oil. A preferred embodiment also includes bleaching means that effects the contact of the glyceride oil to a bleaching agent such that a bleach-treated glyceride oil is physically separated from the agglomerated contaminants. The bleaching means may be incorporated into the separation means. The apparatus may also contain deodorizing means.

The product produced with the method of the invention is a refined glyceride oil from crude glyceride oil refined through contact with an agglomeration agent that acts to reduce soap content to no more than 80 parts per million.

The method and apparatus of the present invention as well as other features, advantages, benefits and objects thereof over other methods and apparati known in the art may be better understood with reference to the detailed description which follows in conjunction with the drawings.

DETAILED DESCRIPTION OF THE INVENTION

Figure 1A:
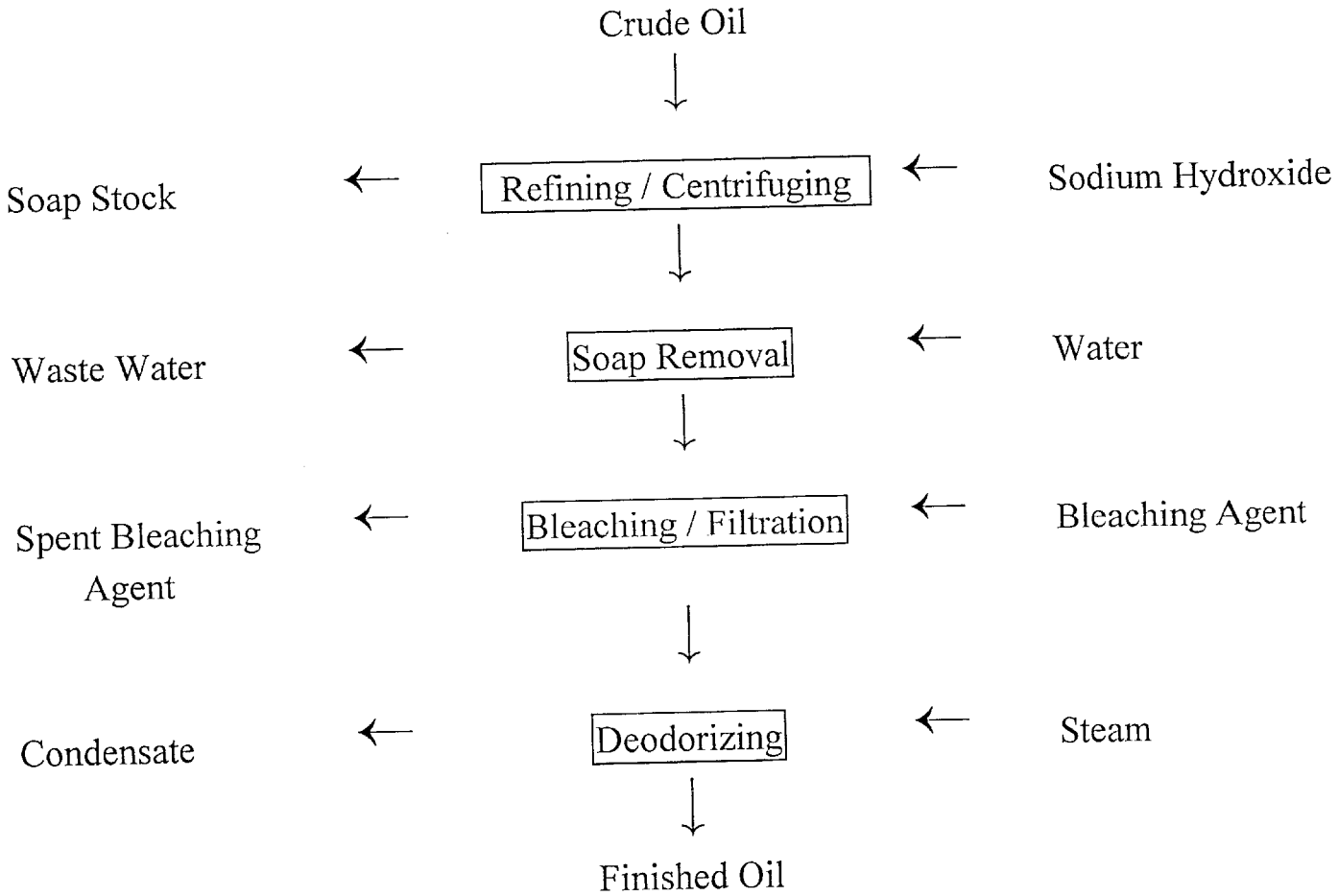
FIG. 1 are block diagrams of the prior art.
Figure 1B:
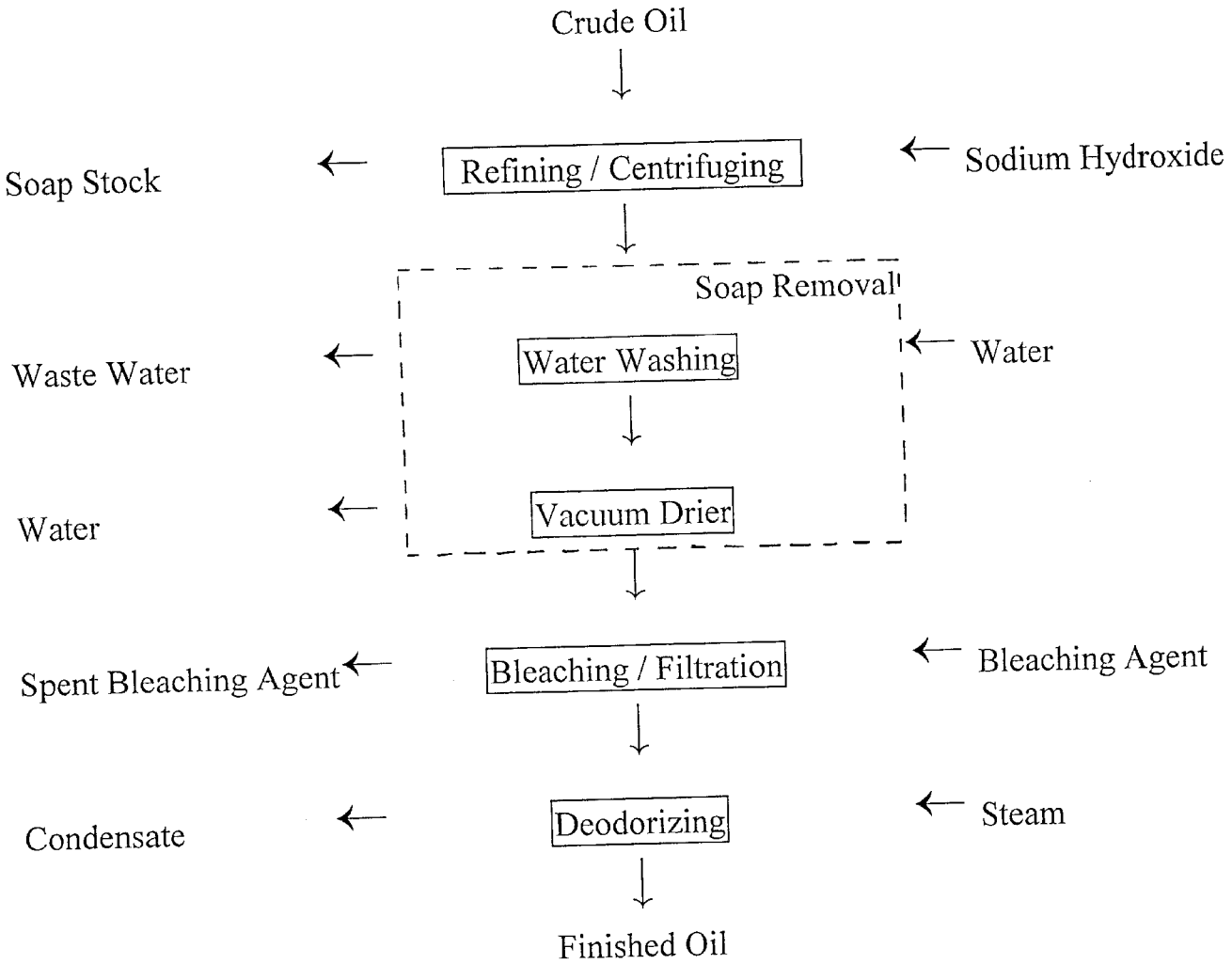
Figure 1C:
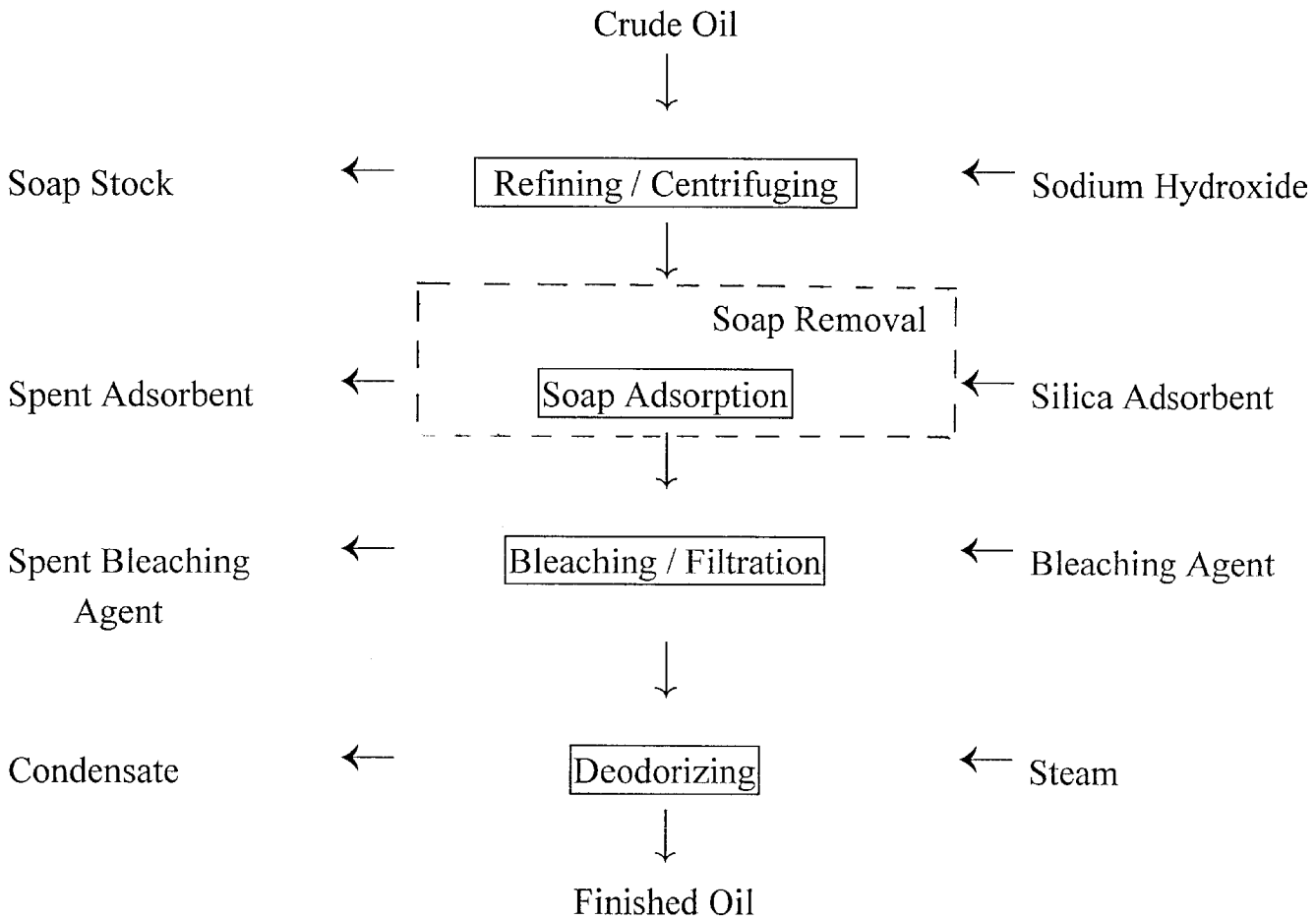
Figure 2:
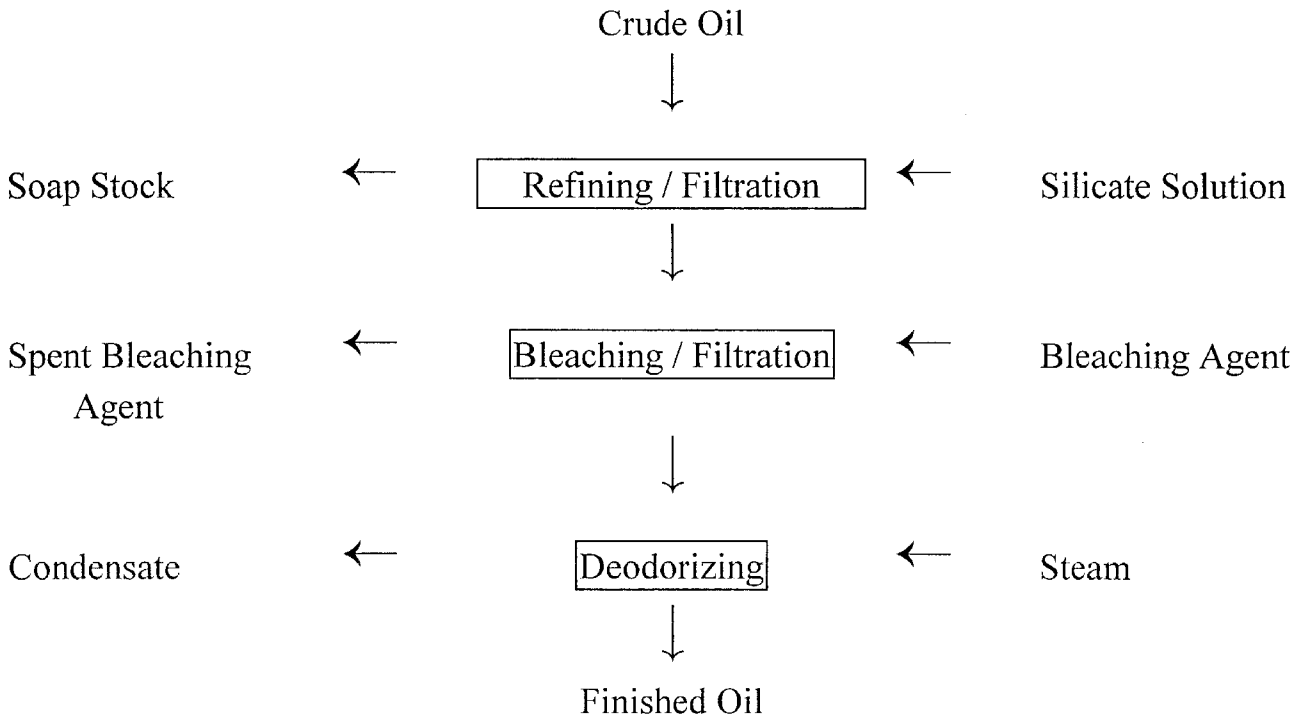
FIG. 2 is a block diagram of a preferred embodiment of the current invention.
Figure 3:
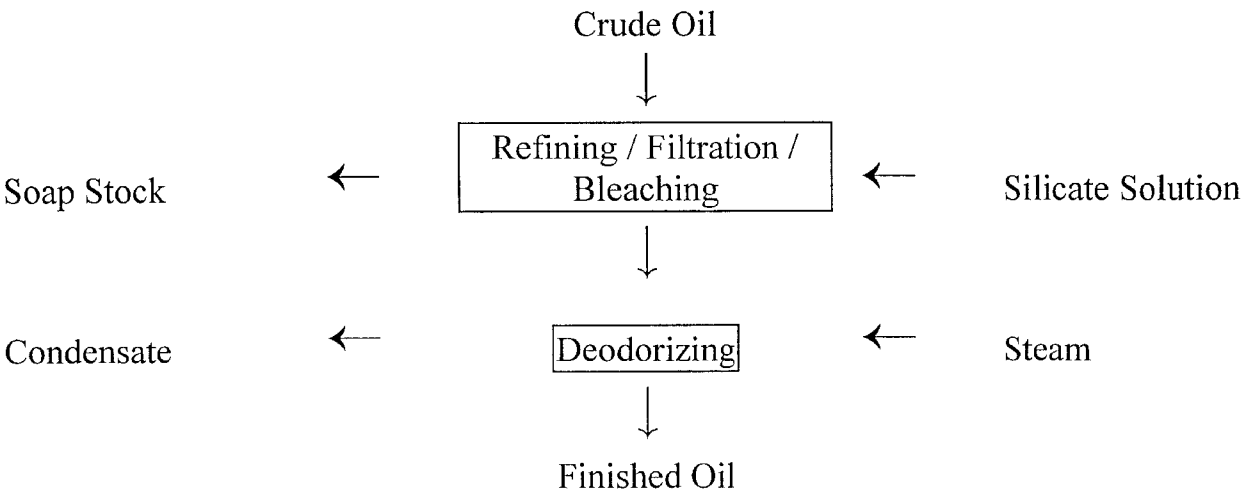
FIG. 3 is a block diagram of an alternate preferred embodiment of the current invention.

Silicate solutions react to neutralize free fatty acids in crude oils. The contaminants readily agglomerate which allows for filtration to separate the contaminants from the glyceride oil. When combined with an optional pretreatment step of bleaching and/or adsorbent treatment of the oils, this filtration provides a simplified method for refining of crude glyceride oils.

Effective liquid refining agents include soluble silicate solutions, with sodium metasilicate being a preferred silicate. The agglomerated soapstock is a mesh of interlocking neutralized free fatty acids and silica gel produced by the introduction of the soluble silicate solution. In effect, silica gel is produced in situ binding the contaminants. Other contaminants present in the glyceride oil will be contained in this discrete phase. In a preferred embodiment, the agglomerated soapstock is separated from the glyceride oil through filtration. The invention creates a clear boundary definition for the discrete phase when silica gel is formed with the interaction of the crude oil with contaminants with the soluble silicate solution.

The apparatus of the current invention includes means for introducing a silicate solution into a crude glyceride oil. The silicate solution is a non-dilute solution. Means for heating the silicate-treated crude oil is provided such that the silicate-treated crude oil is heated to a temperature at which agglomeration occurs, forming the discrete phase containing the agglomerated contaminants, and a liquid oil phase. A filtration device receives the silicate-treated crude oil for separation of the solid phase from the liquid phase, such liquid phase including refined glyceride oil. The refined glyceride oil received from the filtration device can then be subjected to means for bleaching and/or means for deodorizing, with finished oil as a product.

While previous experimentation has indicated some marginal success with the use of sodium metasilicate in a dilute solution when treated by centrifugation, glyceride oils treated with such dilute solutions at normal refining temperatures remain in a single liquid phase. If a water wash is used, then two liquid phases are formed which cannot be separated by simple means of filtration. There are described various methods for chilling treated glyceride oil for purposes of dewaxing, but soapstock is traditionally removed in its liquid form based upon density differences with the glyceride oil. Centrifugation techniques employ solutions of approximately 10% by weight of metasilicate with temperatures ranging from below the melting point of the heavy impurities up to about 150° F. (~66° C.).

The current invention, surprisingly, involves solidifying the soapstock at a temperature higher than previously used in liquid-liquid separation. In a preferred embodiment, additions of sodium metasilicate at approximately 40% by weight create stable soapstock flocks at the increased temperature of about 170° F. (~77° C.) to 190° F. (~88° C.) or 200° F. (~93° C.). The solid matter can then easily be filtered by traditional means. The use of diatomaceous earth or other filter aid assists in such filtration processes. Acid-activated bleaching clay, which is frequently used for bleaching, also acts as a filter aid. Fuller's earth functions in the same way. Filter aids are optional as the simple filtration can separate the discrete phase from the oil. Commercial filtration means can include rotary filter, filter press or leaf filter, filter cloth, metal gauze or any other variety of filtration method. The filter cake produced by filtration means is a waste product of this system. Through the use of the silicate solution, the filter cake contains relatively little residual oil, thus minimizing disposal problems. As use of the silicate solution avoids the need of a water wash, no contaminated water stream exists for disposal.

Advantages achieved by the method of the invention include a reduction in processing costs due to the elimination of the need for centrifuge equipment. A water wash step is eliminated as most soaps are eliminated in the filtration step. Also, soluble silicate is not harsh like caustic solution, and thus does not destroy valuable nutrients lost by prior art methods. The current trend in the food industry is towards the development of high oleic content in unsaturated oils. Thus, genetically modified vegetable oils, such as soy, are increasingly in demand. There is also an intense focus on nutrients such tocopherol (vitamin E) and oryzanol (a cholesterol-lowering phytochemical), not only for the food industry but for the pharmaceutical industry. These too are partially or completely destroyed by conventional caustic refining.

From the foregoing it will be seen that this invention is one well adapted to attain all of the ends and objects herein above set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

For example, the surprising result of solidification upon increased temperature and concentration of the neutralizing silicate solution allows for variation of processing conditions while still maintaining these features. Such variations of processing conditions are encompassed within this invention. Various silicates perform the same function at different conditions and are thus fairly within the scope of the invention. Silicate, while described as a solution, can be provided in any form, including solid, such that a solution is formed with the glyceride oil. Further additives can be used to harden or compress the agglomerated solids or to permit maintenance of such flocs over extended periods, relative to processing needs.

We claim:

1. Method of refining glyceride oil to remove contaminants, comprising the steps of:

contacting the glyceride oil with an agglomeration agent causing the contaminants to agglomerate, the concentration of agglomeration agent being effective to form two discrete phases; and filtering the agglomerated contaminants from the glyceride oil.

2. The method of claim 1 wherein the glyceride oil is crude vegetable oils.

3. The method of claim 1 wherein the glyceride oil contains triglycerides.

4. The method of claim 1 wherein the glyceride oil is rice bran oil.

5. The method of claim 1 wherein the glyceride oil is soybean oil.

6. The method of claim 1 wherein the contaminants include free fatty acids, waxes, metal ions, phospholipids, pigments or oxidation products.

7. The method of claim 1 wherein:

the agglomeration agent is a soluble silicate solution, the concentration of soluble silicate solution being effective to form a discrete phases and a liquid phase.

8. The method of claim 7 wherein the oil has a temperature during contact with the soluble silicate solution, said temperature being maintained above 150° F. (~66° C.).

9. The method of claim 7 wherein the oil has a temperature during contact with the soluble silicate solution, said temperature being maintained between 170° F. (~77° C.) and 200° F. (~93° C.).

10. The method of claim 7 wherein the concentration of soluble silicate is from at least fifteen (15) percent by weight in the soluble silicate solution up to the solubility limit.

11. The method of claim 7 wherein the soluble silicate in the solution is sodium silicate.

12. The method of claim 11 wherein a weight ratio of silicon dioxide to sodium oxide is less than about 3.3.

13. The method of claim 11 wherein the weight ratio of silicon dioxide to sodium oxide is between 0.91 to 3.3.

14. The method of claim 1 further comprising the step of:

adding a filter aid.

15. The method of claim 14 wherein the filter aid is diatomaceous earth.

16. The method of claim 14 wherein the filter aid is acid-activated bleaching clay.

17. The method of claim 1 further comprising the step of adding a bleaching agent that functions to bleach and facilitate filtration.

18. The method of claim 17 wherein the bleaching agent is pre-coated on a filter.

19. The method of claim 1 wherein filtration includes use of a filter that is precoated with a bleaching agent.

20. The method of claim 1 wherein the oil temperature during the contact with the agglomeration agent is maintained above 150° F. (~66° C.).

21. The method of claim 1 wherein the oil temperature during the contact with the agglomeration agent is maintained between 170° F. (~77° C.) and 200° F. (~93° C.).

22. A refined glyceride oil comprising crude glyceride oil refined through contact with an agglomeration agent in sufficient quantity to form two discrete phases, said discrete phases being separated by filtration, such that soap content is reduced to no more than 80 parts per million.

* * * * *